US006015448A

United States Patent [19]

Kaiser et al.

[11] Patent Number: 6,015,448

[45] Date of Patent: Jan. 18, 2000

[54] PROCESS FOR PIG IRON DESULPHURIZATION

[75] Inventors: Heinz-Peter Kaiser, Neukirchen-Vluyn; Klaus-Jürgen Richter, Sonsbeck; Niclas Müller, Ratingen, all of Germany

[73] Assignee: Mannesmann Aktiengesellschaft, Düsseldorf, Germany

[21] Appl. No.: 08/988,280

[22] Filed: Dec. 10, 1997

[30] Foreign Application Priority Data

Dec. 18, 1996 [DE] Germany ..... 196 54 501

[51] Int. Cl.[7] ..... C21B 3/02

[52] U.S. Cl. ..... 75/560; 75/566; 75/568; 420/22

[58] Field of Search ..... 420/22, 29; 75/560, 75/566, 568

[56] References Cited

U.S. PATENT DOCUMENTS 2,906,617 9/1959 Wahl ..... 420/22

4,364,771 12/1982 Cordier et al. ..... 75/535

FOREIGN PATENT DOCUMENTS 38 36 549 C1 10/1988 Germany .

88 16 829 U 12/1990 Germany .

54-150389 11/1979 Japan .

*Primary Examiner*—Melvyn Andrews

*Attorney, Agent, or Firm*—Cohen, Pontani, Lieberman & Pavane

[57] ABSTRACT

Disclosed is a process for desulphurization of a pig iron melt for further processing wherein the melt is brought into close contact with a ground solid slag. As desulphurizing agent, the slag accumulating in secondary steelmaking with a basicity of at least 4, an iron content in the range of 4 to 6 wt.-% and a phosphorous content in the range ≦0.4 wt.-%, is used in ground form or the slag is used together with calcium carbide and magnesium as a solid mixture in ground form.

10 Claims, No Drawings

PROCESS FOR PIG IRON DESULPHURIZATION

BACKGROUND OF THE INVENTION

The invention relates to a process for the desulphurization of a pig iron melt which is to be further processed into steel in an oxygen top blowing converter wherein the melt is poured into a ladle and brought into contact with a solid slag that contains calcium oxide which accumulates in the steel manufacturing process as well as other desulphurization agents.

A general process for the desulphurization of pig iron is known from DE 38 36 549 C1. In this process, the converter slag that accumulates during the oxygen top blowing process is used as the desulphurization slag. The converter slag in molten form is optionally poured directly from the converter into the treatment ladle intended to accommodate the pig iron, and then the pig iron is poured onto the slag. Alternatively, it is proposed that converter slag, after having been poured from the converter, is cooled and processed into small pieces with a maximum piece size of 50 mm, and is then added to the pig iron in this form. A disadvantage of this known process is that the converter slag has a low sulfide capacity, so that the amount of additional expensive desulphurization reagents required is still very high.

DE 88 16 829.8 U1 discloses a mixture of calcium carbide and magnesium as an agent for the desulphurization of pig iron melts. To ensure good dosability during injection, and to prevent separation even during long periods of standing or during transport, it is proposed that the bulk weight and grain size of the two components be in the same range. In a preferred embodiment, the two components are coated with an oily liquid. This reduces the possibility of separation and permits even more precise dosing.

The object of the present invention is to provide a process for the desulphurization of pig iron, in which the relative amount of the usual expensive desulphurization reagents, such as calcium carbide and magnesium, is significantly reduced and the amount of slag to be deposited and disposed of is decreased.

THE INVENTION

The above stated object is obtained by means of the present invention.

In the process of the present invention, the slag accumulating in secondary steelmaking is used. The slag has a basicity of at least 4, a low iron content in the range of 4 to 6 wt.-%, a phosphorous content in the range ≦0.4 wt.-% and is used alone in ground form as the slag or, the slag, accumulating in secondary steelmaking, can be used together with calcium carbide and magnesium as a solid mixture in ground form as the desulphurizing agent.

In one embodiment, the mixture has a particle size of less than 1 mm, with an average size for the calcium carbide of 0.3 mm, 0.5 mm for Mg. and 0.7 mm for the slag. Optionally, the slag is subjected to a drying treatment. The desulphurization agent can be blown into the melt under an overpressure. The desulphurization agent can be introduced into the pig iron in the ladle, the blast furnace ladle or the pig iron runner.

In contrast to the prior art, no converter slag is used; rather, slag that accumulates in secondary steelmaking, e.g., casting ladle slag or calcium carbide with magnesium alone, or slag together with calcium carbide and magnesium, is used as a solid mixture in ground form. Upstream grinding makes the desulphurization reagents pneumatically conveyable, and desulphurization conditions are improved because the specific surface is enlarged by the size reduction. The grain size for all reagents used is under 1 mm; the average is 0.3 mm for calcium carbide, 0.5 mm for magnesium and 0.7 mm for the slag. The advantage of using this slag is that the slag has a basicity of at least 4 as well as a low iron content in the range of 4 to 6 wt.-% and a phosphorous content of ≦0.4 wt.-%. Because the casting ladle slag usually still has an average relative humidity of 8%, it is subjected to grinding drying, for example, to avoid baking in the immersed lance. The secondary steelmaking slag prepared in this fashion is suitable for introduction via an immersion lance, as desired, directly into the pig iron treatment ladle, the blast furnace ladle or the pig iron runner.

The use of casting ladle slag as the desulphurization reagent reduces the costs for the process of pig iron desulphurization. At the same time, the amount of slag to be deposited and disposed of is reduced, which is also economically advantageous.

The process according to the invention will be explained in greater detail in reference to an example.

200 t pig iron with an S content of 500 ppm are placed into a treatment ladle. By blowing in 100% pulverized casting ladle slag (20 kg/t pig iron), the sulphur content in the pig iron is lowered within 15 minutes to ≦200 ppm. Further desulphurization is carried out with the addition of calcium carbide and magnesium.

The terms and expressions which have been employed are used as terms of description and not of limitation, and there is no intention in the use of such terms and expressions of excluding any equivalent of the features shown and described or portions thereof, it being recognized that various modifications are possible within the scope of the invention.

We claim:

1. A process for desulphurization of a pig iron melt for further processing comprising: contacting the melt with a desulphurization reagent in ground form wherein the reagent is a slag accumulating in secondary steelmaking, the slag having a basicity of at least 4, an iron content in the range of 4 to 6 wt.-% and a phosphorous content in the range ≦0.4 wt.-%, or said slag accumulating in secondary steelmaking together with calcium carbide and magnesium as a solid mixture in ground form.

2. The process of claim 1 wherein the ground slag size is under 1 mm.

3. The process of claim 2 wherein the desulphurization agent includes calcium carbide having an average size of 0.3 mm, magnesium having an average size of 0.5 mm and slag having an average size of 0.7 mm.

4. The process of claim 1 wherein the slag is subjected to a drying treatment.

5. The process of claim 1 wherein the desulphurization reagent is blown into the melt under pressure.

6. The process of claim 1 wherein the desulphurization reagent is introduced into the melt in a pig iron ladle, a blast furnace ladle or a pig iron runner.

7. The process of claim 1 wherein the slag is used for pre-desulphurization of the pig iron, and comprising adding calcium carbide and magnesium for further desulphurization.

8. The process of claim 1 wherein the calcium oxide containing slag used for desulphurization accumulates in the steel manufacturing process.

9. The process of claim 1 wherein the melt is further processed in an oxygen top blowing converter.

10. The process of claim 1 wherein the desulphurization agent consists of in, ground form, a slag accumulating in secondary steelmaking, the slag having a basicity of at least 4, an iron content in the range of 4 to 6 wt.-% and a phosphorous content in the range ≦0.4 wt.-%, or said slag accumulating in secondary steelmaking together with calcium carbide and magnesium as a solid mixture in ground form.

* * * * *